US010682616B2

(12) United States Patent
Lenz et al.

(10) Patent No.: US 10,682,616 B2
(45) Date of Patent: Jun. 16, 2020

(54) CENTRIFUGE WITH EXCHANGEABLE ROTORS

(71) Applicant: Andreas Hettich GmbH & Co. KG, Tuttlingen (DE)

(72) Inventors: Anke Lenz, Leibertingen (DE); Ulrich Massing, Merzhausen (DE); Klaus-Guenter Eberle, Tuttlingen (DE); Vittorio Ziroli, March (DE)

(73) Assignee: ANDREAS HETTICH GmbH & CO. KG, Tuttlingen (DE)

( * ) Notice: Subject to any disclaimer, the term of this patent is extended or adjusted under 35 U.S.C. 154(b) by 108 days.

(21) Appl. No.: 15/554,579

(22) PCT Filed: Mar. 11, 2016

(86) PCT No.: PCT/EP2016/055306
§ 371 (c)(1),
(2) Date: Aug. 30, 2017

(87) PCT Pub. No.: WO2016/146527
PCT Pub. Date: Sep. 22, 2016

(65) Prior Publication Data

US 2018/0036694 A1 Feb. 8, 2018

(30) Foreign Application Priority Data

Mar. 13, 2015 (DE) ..... 10 2015 103 752

(51) Int. Cl.
*B01F 9/00* (2006.01)
*B04B 5/04* (2006.01)
(Continued)

(52) U.S. Cl.
CPC ..... *B01F 9/0001* (2013.01); *B01F 9/0003* (2013.01); *B01F 15/00435* (2013.01);
(Continued)

(58) Field of Classification Search
CPC ..... B01F 15/00896; B01F 15/00746; B01F 9/0001; B01F 15/00824; B01F 15/00831;
(Continued)

(56) References Cited

U.S. PATENT DOCUMENTS 3,199,775 A * 8/1965 Drucker ..... B04B 5/02 366/217
4,728,197 A * 3/1988 Reinhard ..... A61C 9/0026 366/219
(Continued)

FOREIGN PATENT DOCUMENTS

CA 2 546 251 A1 11/2007
DE 101 43 439 A1 3/2003
(Continued)

OTHER PUBLICATIONS

International Search Report and Written Opinion dated Jul. 7, 2016, issued in counterpart PCT application PCT/EP2016/055306.
(Continued)

*Primary Examiner* — Charles Cooley
(74) *Attorney, Agent, or Firm* — Juan Carlos A. Marquez; Marquez IP Law Office, PLLC

(57) ABSTRACT

A dual centrifuge (10) embodies the following: a driveshaft (16), a rotor (20), which is mounted on the driveshaft (16) and which can be removed axially in a removal direction (E), for a dual centrifuge, having at least one rotational unit (30); an opening (18) in the rotor (20), wherein an end region (16*a*) of the driveshaft (16) at least engages into said opening; and an additional drive mechanism (32) for the rotational unit or the rotational units (30). The dual centrifuge additionally has a design for operating various additional types of rotors; however, only one rotor (20, 40, 50) can be arranged on the driveshaft (16) at all times. The various rotor types (40, 50) are also adapted to the additional drive mechanism (32) for the rotational units (30) such that
(Continued)

the function is not adversely affected. A design for operating at least one angular head rotor (40) and a swing-out rotor (50). For this purpose, the driveshaft (16) and the various rotor types (40, 50) are adapted to each other. The bearing (16), the driveshaft (16), and the various rotor types (40, 50) are adapted to one another such that each non-dual rotor (40, 50) has a geometry that is measured such that when the rotor (40, 50) is mounted, a drive device (32*a*) of the additional drive mechanism (32) for the rotational units (30) is arranged so as to not contact the mounted rotor (40, 50).

10 Claims, 8 Drawing Sheets

(51) Int. Cl.
*B04B 5/10* (2006.01)
*B02C 17/08* (2006.01)
*B04B 5/02* (2006.01)
*B01F 15/00* (2006.01)

(52) U.S. Cl.
CPC ..... *B02C 17/08* (2013.01); *B04B 5/02* (2013.01); *B04B 5/0414* (2013.01); *B04B 5/0421* (2013.01); *B04B 5/10* (2013.01); *B01F 2015/0011* (2013.01); *B01F 2015/00623* (2013.01)

(58) Field of Classification Search
CPC ..... B01F 9/0003; B01F 9/0021; B01F 2009/0067; B01F 2015/0011; B01F 2015/00642; B01F 15/00435; B01F 2015/00623; A23G 9/086; A23G 9/106; A23G 9/22; A23G 9/08; A23G 9/224; G05B 15/02; A23V 2002/00; B04B 5/02; B04B 9/14; B04B 9/12; B04B 5/0414; B04B 5/0421; B04B 5/10; B02C 17/08
USPC ..... 366/209–219; 494/19; 433/49, 90, 91
See application file for complete search history.

(56) References Cited

U.S. PATENT DOCUMENTS

| | | | | | |
|---|---|---|---|---|---|
| 5,352,037 | A * | 10/1994 | Jouvin | B01F 9/0001 | 366/219 |
| 10,322,419 | B2 * | 6/2019 | Eberle | B01F 9/0001 | |
| 2008/0192564 | A1 * | 8/2008 | Jouvin | A61K 6/10 | 366/7 |
| 2009/0285050 | A1 * | 11/2009 | Wang | B01F 9/0001 | 366/206 |
| 2015/0174539 | A1 * | 6/2015 | Eberle | B01F 9/0001 | 366/218 |
| 2017/0348653 | A1 * | 12/2017 | Dobos | B01F 9/0001 | |
| 2018/0036694 | A1 * | 2/2018 | Lenz | B01F 9/0001 | |
| 2018/0036744 | A1 * | 2/2018 | Eberle | B02C 17/08 | |

FOREIGN PATENT DOCUMENTS

| | | | | |
|---|---|---|---|---|
| DE | 10 2012 105 819 | A1 | | 4/2014 |
| JP | 2009-119587 | A | | 6/2006 |
| JP | 2010051903 | A | * | 3/2010 |
| WO | 2011/136023 | A1 | | 11/2011 |
| WO | 2013/183554 | A1 | | 12/2013 |

OTHER PUBLICATIONS

German Search Report dated Dec. 14, 2015, issued in counterpart German Patent Application No. 10 2015 103 752.1.
Rotana 460R, D-78532 Tuttlingen, Andreas Hettich GmbH & Co. KG, Apr. 25, 2014, Firmemschrift.
English Translation of the Notification of Transmittal of the International Preliminary Report on Patentability dated Sep. 28, 2017, issued in counterpart PCT application PCT/EP2016/055306.

* cited by examiner

CENTRIFUGE WITH EXCHANGEABLE ROTORS

BACKGROUND OF THE INVENTION

The invention relates to a dual centrifuge of the type wherein the rotors for the dual centrifuge can be exchanged fast and easily, in particular without the use of additional tools, and that the same dual centrifuge allows the use of other types of centrifuge rotors to perform various functions.

In the fields of biology and chemistry, centrifuges are frequently used for separating materials. The term standard centrifuge refers to both tabletop centrifuges and standard centrifuges which have a safety vessel and a safety lid, with the diameter of the safety vessel being between 15 cm and 65 cm, preferably between 20 cm and 50 cm. These centrifuges offer the possibility of removing the rotors, or also of exchanging the rotors. Because high speeds are required for the separation of mixtures, the maximum speed of these centrifuges is 25,000 rpm.

Dual centrifuges are already known from the prior art of laboratory technology. Contrary to standard centrifuges, however, these prior art dual centrifuges are not used for the separation of substances but for performing highly efficient mixing, homogenizing, grinding, extracting processes as well as tissue disruption processes.

Dual centrifuges have rotational units mounted in the rotor, which units receive containers holding samples to be processed and which rotate about a secondary rotational axis that is different from the main rotational axis of the rotor. For this purpose, an additional drive mechanism is provided for the rotational units, besides the rotor drive mechanism.

In the various dual centrifuges of the prior art, this additional drive mechanism has been implemented in different ways. DE 101 43 439 A1 for example discloses a dual centrifuge in which the additional drive mechanism for the rotational units is mounted below the rotor. The additional drive mechanism consists of a stationary taper washer on the motor housing and a taper washer which is connected to a rotational unit on the rotor, both taper washers being connected to one another via a V-belt.

Another example is the dual centrifuge described in DE 10 20 12 105 819 A1, in which a gear is mounted below the rotor on the housing of the centrifuge motor for co-rotation therewith. The rotational units each have toothing in their peripheral regions, which toothing is adapted to mesh with the gear. When the rotor rotates about the motor axis relative to the housing, the rotational units will likewise be rotated about their axes of rotation as a result of the peripheral toothing meshing with the stationary gear.

The dual centrifuges (DC) proposed above do not provide for a removal of the DC rotor—except for servicing and repairs. Removing and exchanging the DC rotor is time-consuming and usually requires the use of tools, and particular care must be exercised when installing the rotor.

In the current prior art, dual centrifuges can thus only be used without a lot of effort with single rotor that is specifically designed for use in a dual centrifuge—which offers little flexibility.

As an alternative to the above mentioned solutions, the additional drive mechanism can also be integrated into a hollow shaft, as is the case in JP 2009119587 A. However, such an arrangement of the additional drive mechanism makes it even more difficult to remove and exchange the rotor.

SUMMARY OF THE INVENTION

It is the object of the present invention to improve on a dual centrifuge in such a manner, and avoiding the above mentioned short-comings, that rotors for dual centrifuges, hereinafter referred to as DC rotors, can be exchanged fast and easily, in particular without the use of additional tools, and that furthermore one and the same dual centrifuge also allows the use of other types of centrifuge rotors such as angle rotors or swing-out rotors. A dual centrifuge for mixing, homogenizing, grinding etc. is thus temporarily transformed into a conventional centrifuge for separating sample components. The size of the centrifuge can thus be kept compact.

This object is accomplished by the characterizing features set forth in at least the independent claim.

The subclaims define advantageous embodiments of the invention.

The invention is based on the finding that a rotor for a dual centrifuge can be designed such that it can be removed from and/or installed in the dual centrifuge without requiring any additional steps. Furthermore, the dual centrifuge and other rotor types without any additional rotary mechanism, i.e. at least an angle head rotor or a swing-out rotor, can be adapted to one other in such a way that rotors having an additional rotary mechanism as well as rotors without any additional rotary mechanism can likewise be mounted in the dual centrifuge without adversely affecting its performance.

Moreover, the drive for the additional rotary mechanism of the DC rotor, for example the gear mounted on the centrifuge motor housing, can be designed and installed in such a space-saving manner that conventional rotors, for example a swing-out rotor or a fixed angle rotor, can be mounted in the centrifuge without requiring any further adaptation.

According to the invention, the dual centrifuge therefore comprises a driveshaft, a DC rotor which is mounted on the driveshaft and which can be removed axially in a removal direction, having at least one rotational unit, a bearing for the rotor which bearing is connected to the driveshaft and supports the rotor at least against the removal direction, an opening in the rotor which opening is engaged at least by an end portion of the driveshaft, and an additional drive mechanism for the one or plural rotational unit(s). Its inventive design makes the centrifuge suitable for operating various different types of rotors, at least an angle head rotor or a swing-out rotor, because the bearing, the driveshaft and the various rotor types are adapted to one another. However, only one of these rotors can be mounted on the driveshaft at a time. The various rotor types without an additional rotary mechanism are also adapted to the drive means for the additional rotary mechanism in such a way that they will not impair its operation. Several different types of rotor can thus be mounted in the dual centrifuge. The centrifuge can be used to process samples in different ways, for which different rotors are required. The angle head rotor and the swing-out rotor are dimensioned such that, once the angle head rotor or swing-out rotor is mounted, the drive means for the additional drive mechanism for the dual centrifuge rotor will not make contact with the mounted rotor. This spaced arrangement clearly reduces or even eliminates any danger of damage to the additional rotary mechanism or the mounted rotor without additional rotary mechanism in operation. This compatible design of the swing-out rotor and angle head rotor ensures that these will not make contact with the non-rotatable gear.

Moreover, the design of the non-rotatable gear can be as compact and flat as possible so that even more rotors can be mounted without requiring further measures.

In one aspect of the invention, a set of different types of rotors is provided and each rotor of this set has a quick fastener for securely mounting it on the driveshaft. This has the advantage that it ensures a particularly simple, fast and safe change of rotors. This quick fastener may for example be a screw which can be released or tightened easily and fast using an Allen key, or a push-down mechanism which makes opening and closing even easier.

In another embodiment the drive means for the additional drive mechanism is mounted and/or adapted such that non-dual rotors can also be used in the dual centrifuge without requiring any adaptation. More specifically, the drive means for the additional drive mechanism is designed and mounted in such a compact manner that rotors without any additional rotary mechanism so far only intended for use in standard centrifuges can also be mounted and used in the centrifuge without adaptation. The drive means can be designed as a single extremely small gear, for example.

More specifically, the drive means for the additional drive mechanism may be in the form of a nonrotatably mounted gear which is engaged by the toothing of the rotational unit when mounted in the dual rotor located in the centrifuge or when the dual rotor with the rotational units is mounted in the centrifuge. This makes it easy to insert or remove rotors, not only dual rotors but also standard rotors. Moreover, rotors can be connected to the centrifuge in the same manner, for example shaft with taper and locking screw. Furthermore, the geometries of the non-rotatably mounted gear and of the gears of the rotational units of a dual rotor can be matched to one another in such a way that the gears will automatically mesh when the dual rotor with the rotational units or a rotational unit each is inserted into the rotor arranged in the centrifuge, without requiring any further measures.

Another advantage here is that, if a drive means for the additional drive mechanism is of such a compact design, it will be possible to retrofit the additional drive mechanism into a centrifuge developed for standard purposes and then also use this centrifuge for dual centrifugation. This will keep costs very low if a series-produced centrifuge housing is used. Because various different housings for use as standard centrifuges are on the market, it will be very easy to find an already existing optimal series-produced centrifuge housing for certain sets of DC rotors or non-dual rotors. This makes it easy to operate various different DC rotors. Moreover, this is a very economical solution since it allows existing standard centrifuges to be converted into dual centrifuges by simply adding a gear and a suitable DC rotor.

For dual centrifuges, same as for standard centrifuges, it is very advantageous if the driveshaft is directly connected to a drive motor, and if in particular the driveshaft and a motor shaft of the drive motor constitute a structural unit and are preferably integrally formed and more specifically also made from the same material. Firstly, this is relatively easy to implement technically and also reduces production costs. Secondly, this reduces or eliminates the danger of damage to the connection between the driveshaft and the motor shaft in operation, as is common when a hollow shaft is used, for example. This makes the centrifuge safer in operation.

In an advantageous embodiment of the invention, a safety vessel is provided which houses the rotor and the bearing and into which at least part of the driveshaft projects. The integral design of vessel wall and vessel bottom, and the adaptation of a driveshaft through-passage provided in the vessel bottom to the dimensions of the driveshaft, will not only ensure that any pieces hurled around in the case of a rotor crash will be contained in the safety vessel but also that any escaping fluids in case of an accident will not leak from the vessel and contaminate the working environment. Furthermore, the maximum diameter of a rotor of the set of different types of rotor amounts to 96%, at the most, of the diameter of the safety vessel. This measure prevents rotors or their accessories from making contact with the vessel in the case of a tolerable system-inherent imbalance or of system-inherent vibrations. This does not in any way change the compact design of the centrifuge so that no additional space is required as a result of this measure.

More specifically, the driveshaft is designed as a solid shaft. The required stability for driving the respective rotor can thus be achieved more easily and replacements are also easier.

In a preferred embodiment, at least one rotational unit for the rotor of a dual centrifuge has a pivot bearing and a rotational head which is connected to the pivot bearing and is supported for rotation therein about a rotation axis, which rotational head can be driven relative to the rotor by an additional rotary mechanism of the centrifuge.

It is considered advantageous for the drive means of the additional drive mechanism to be a gear which is firmly connected to the motor housing and penetrated by the driveshaft. This type of mechanism can be implemented easily, is inexpensive and hardly prone to defects. Because the gear is mounted on the motor housing, there is no clearance between the driveshaft and the gear. The gear can thus have a very flat design and still ensure the neat meshing of the gears of the additional rotational unit with the stationary gear, which meshing will not be impaired by the usual outward oscillation of the centrifuge. This guarantees safe operation of the centrifuge.

The decisive factor for the proper dimensioning of the gears to be fitted is the distance between the underside of the rotor and the motor housing in the fitted state. Experience has shown that for a distance of approx. 10 mm which is frequently found in standard centrifuges in practice, firstly a gear height of at least 3 mm is required to ensure reliable meshing of the gear with the toothing, and secondly, a gear height of 8 mm leaves sufficient clearance between the gear and the underside of the rotor. Gear heights of between 3 mm and 8 mm are thus possible. In practice, a height of 6.5 mm has proved to be a good compromise regarding the two abovementioned factors.

In one aspect of the invention, a set of different rotors of a dual centrifuge with different transmission ratios between the additional rotary mechanism and the rotational unit is provided. Rotors having different reverse rotation ratios between the rotational body and the rotor and thus different relative speeds of the rotational units are thus available from which the one best suited for the respective purpose can then be chosen.

In one embodiment of the invention, it has proven advantageous to provide a rotor of a dual centrifuge in which a gear is centrically mounted in such a way that the gear and the rotor constitute a structural unit and the rotor can rotate relative to the gear in operation. In a mounted state, the centrifuge shaft extends through the gear, engages the DC rotor and drives the latter. To prevent the gear from rotating along with the rotor in operation, retaining means, e.g. retaining pins, are provided which will non-rotatably engage recesses in the motor housing when the rotor is mounted in the centrifuge housing. When the rotor is driven, the gears of the rotational units will then mesh with the gear mounted in the rotor. This also drives the rotational units.

Additional advantages, features and possible applications of the present invention will become apparent from the description which follows, in combination with the embodiments illustrated in the drawings.

BRIEF DESCRIPTION OF THE DRAWINGS

Throughout the description, the claims and the drawings, those terms and associated reference signs are used as are listed in the List of Reference Signs below. In the drawings:

DETAILED DESCRIPTION OF THE PREFERRED EMBODIMENTS

Figure 1:
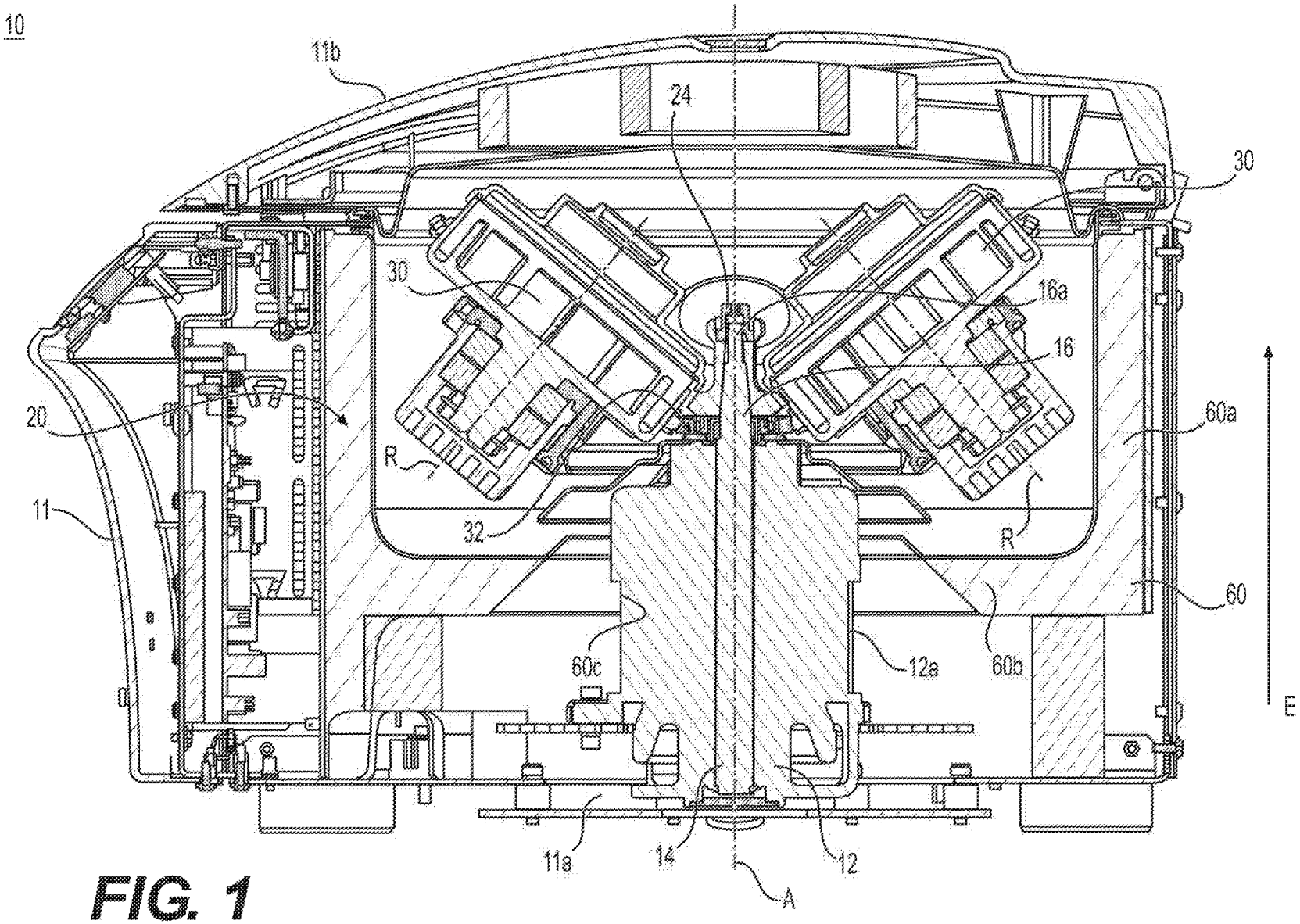
FIG. 1 is a lateral sectional view of a dual centrifuge according to the invention with a DC rotor mounted therein.

FIG. 1 is a lateral sectional view of a dual centrifuge 10 according to the invention having a DC rotor 20 mounted on a drive motor 12. The dual centrifuge 10 is contained in a housing 11 which comprises an underside 11*a* and a housing cover 11*b* which can be opened. When the housing cover 11*b* is open, the DC rotor 20 can be removed vertically in a removal direction E, starting from the underside 11*a*.

Figure 2A:
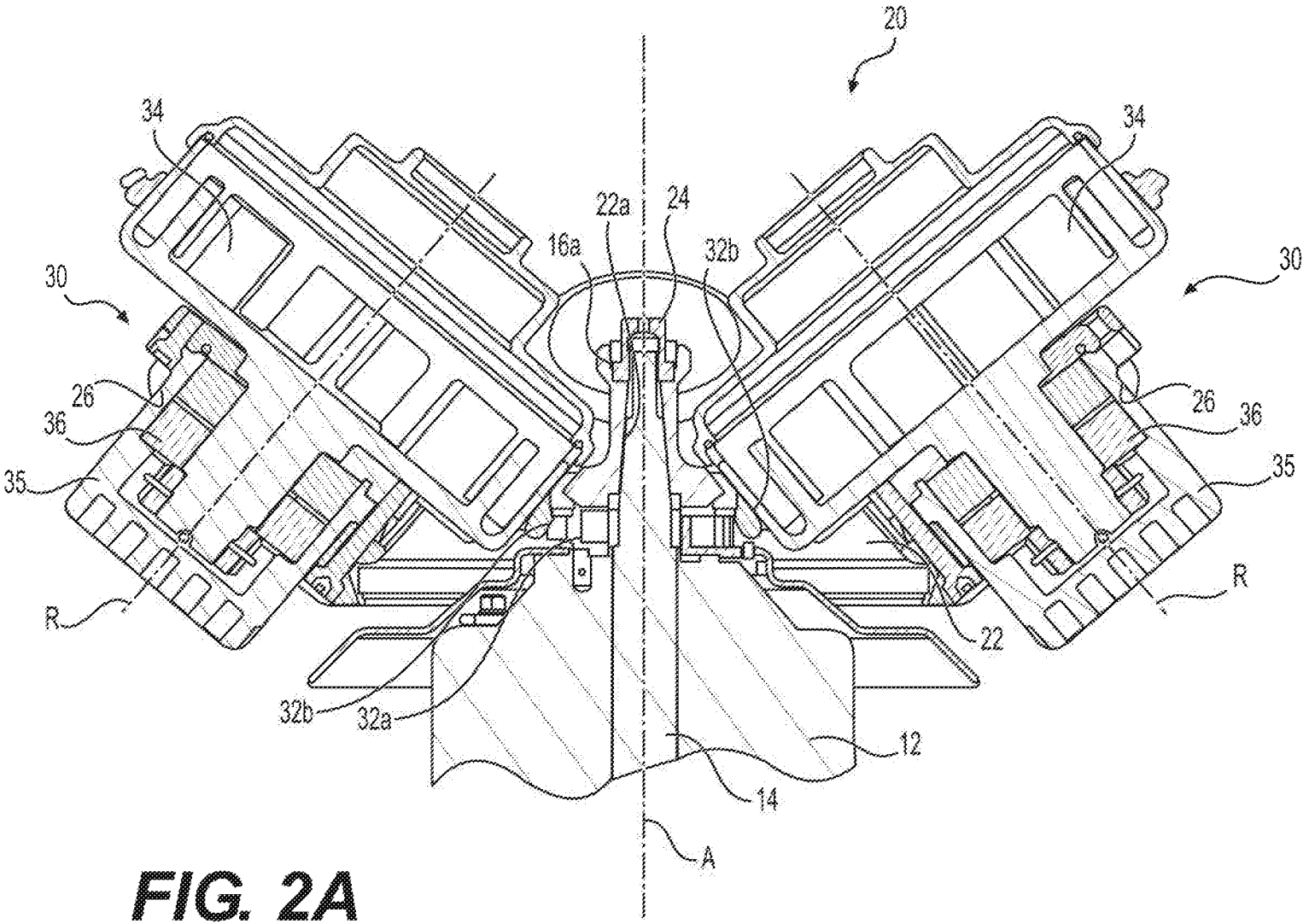
FIG. 2*a* is a lateral sectional view of the DC rotor of FIG. 1 and of the portion of the drive motor which is close to the rotor.

FIG. 2*a* is a view of the DC rotor 20 of FIG. 1 mounted on the drive motor 12, which view only shows the portion of the drive motor 12 which is close to the rotor, without the housing 11.

Within the housing 11, the DC rotor 20 is surrounded by a safety vessel 60 which is arranged concentrically with the DC rotor 20. The safety vessel 60 has a circumferential sidewall 60*a* which is integrally formed with, and made of the same material as, a vessel bottom 60*b* disposed below the DC rotor 20.

An opening 60*c* is provided in the vessel bottom 60*b* which opening 60*c* is concentric with the sidewall 60*a* and the drive motor 12 extends through it. The outer circumference of the drive motor 12 and the opening 60*c* are adapted to one another and provided with a seal (not shown for reasons of clarity). This ensures that in the case of a rotor crash, any flying parts as well as any leakage of material to be centrifuged will be contained within the safety vessel 60.

The drive motor 12 which has a cylindrical motor shaft 14 and which is surrounded by a motor housing 12*a*, is firmly connected to the underside 11*a*. The motor shaft 14 is integrally formed with, and made of the same material as, the driveshaft 16, which has an end portion 16*a* on its free end. The end portion 16*a* tapers in the removal direction E and partly engages the installed DC rotor 20. A drive axis A extends through the motor shaft 14 and the driveshaft 16. A rotor hub 22 of the DC rotor 20 has an opening 22*a* which is concentric with the drive axis A and which has parts of its inner contour adapted to the outer contour of the end portion 16*a* and which also tapers in the removal direction E. This adaptation and the conical taper fix the DC rotor 20 against the removal direction E.

On the side of the DC rotor 20 which faces away from the drive motor 12 a quick fastener 24 is provided which extends into the opening 22*a*, partially surrounds the end portion 16*a* of the driveshaft 16 and secures the DC rotor 20 against accidental removal from the driveshaft 16 by means of a push-down mechanism not shown in FIG. 1. Safety devices of this type are well known from the prior art for which reason no further explanations are required here. Instead of a push-down mechanism, a screw which can simply be released by means of an Allen key could also be chosen as a quick-release fastener.

Two openings 26 are provided in the rotor hub 22 which are disposed opposite each other relative to the opening 22*a*. A rotational unit 30 is mounted in each opening 26. The rotational units 30 comprise a rotational head 34 which is rotatably mounted for supporting sample container receiving units (not shown) for sample containers containing samples to be processed, and a housing 35 in which a bearing 36 for the rotational head 34 is provided. This bearing 36 is in turn penetrated by a bearing shaft of the rotational head 34. This bearing shaft is disposed on the side of the rotational head 34 which faces the housing 35 and is not shown for the reasons of clarity.

The outer profile of the rotational units 30 is rotationally symmetrical and adapted to the inner profile of the opening 26 in the areas associated with the opening 26, and the rotational units 30 have a centric rotational axis R about which they rotate in operation. The rotational units 30 are mounted symmetrically relative to the opening 22*a* in such a manner that their rotational axes R intersect on the drive axis A above the opening 22*a*.

An additional drive mechanism 32 is provided for driving the rotational units 30 which mechanism 32 comprises a stationary central gear 32*a* as well as circumferential toothing 32*b* on either rotational unit 30. The central gear 32*a* is concentric with the drive axis A and disposed on the side of the motor housing 12*a* which faces the DC rotor 20 in such a manner that it surrounds the driveshaft 14. Upon rotation of the DC rotor 20, the teeth of the toothing 32*b* will mesh with the stationary central gear 32*a*, thus causing the rotational units 30 to rotate as the DC rotor 20 rotates in operation.

Figure 2B:
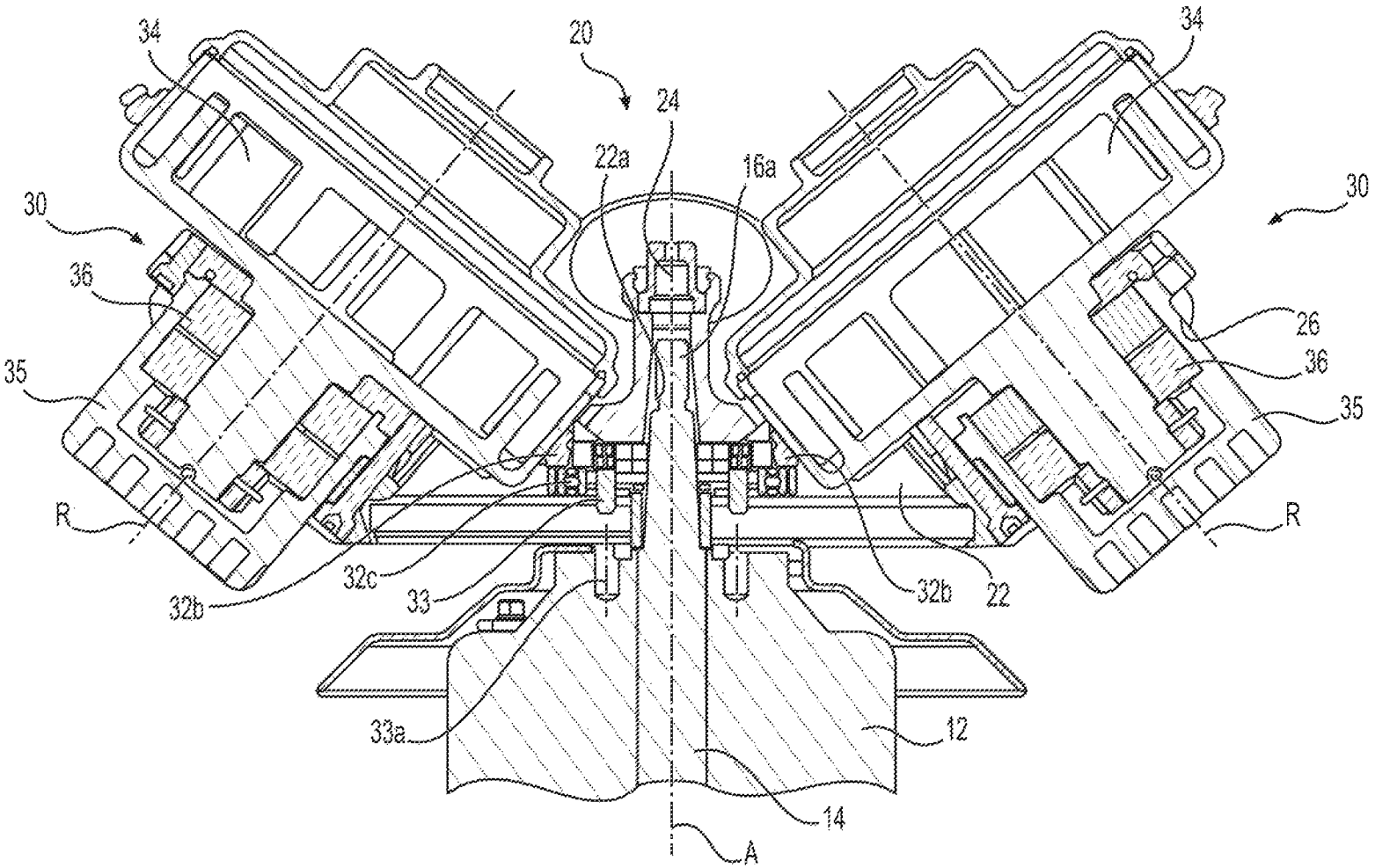
FIG. 2*b* is a lateral sectional view of another inventive embodiment of a DC rotor in the removed condition and of the portion of the drive motor which is close to the rotor.

The only difference between the DC rotor 20 illustrated in FIG. 2*b* and the DC rotor shown in FIG. 2*a* is that instead of a central gear 32*a* mounted on the motor housing 12*a*, a central gear 32*c* is provided which is structurally integrated into the DC rotor 20. The central gear 32*c* is rotatably mounted in the rotor on guiderails (not shown for reasons of clarity) and has two retaining pins 33 on its side facing the drive motor 12, which pins 33 will engage associated recesses 33*a* in the motor housing 12*a* when the DC rotor 20 is mounted on the drive motor 12. The dimensions of the recesses 33*a* are adapted to the dimensions of the retaining pins 33. The retaining pins 33 engaging the recesses 33*a* fix the central gear 32*c* in the mounted state of the DC rotor 20 in such a way that it will not rotate along with the DC rotor 20 in operation. Similar to the principle explained with reference to FIG. 2*a*, the rotational units 30 are made to rotate when the toothing 32*b* meshes with the central gear 32*c* during operation of the centrifuge 10. For reasons of clarity, the view of FIG. 2*b* shows the DC rotor 20 removed from the drive motor 12.

Figure 2C:
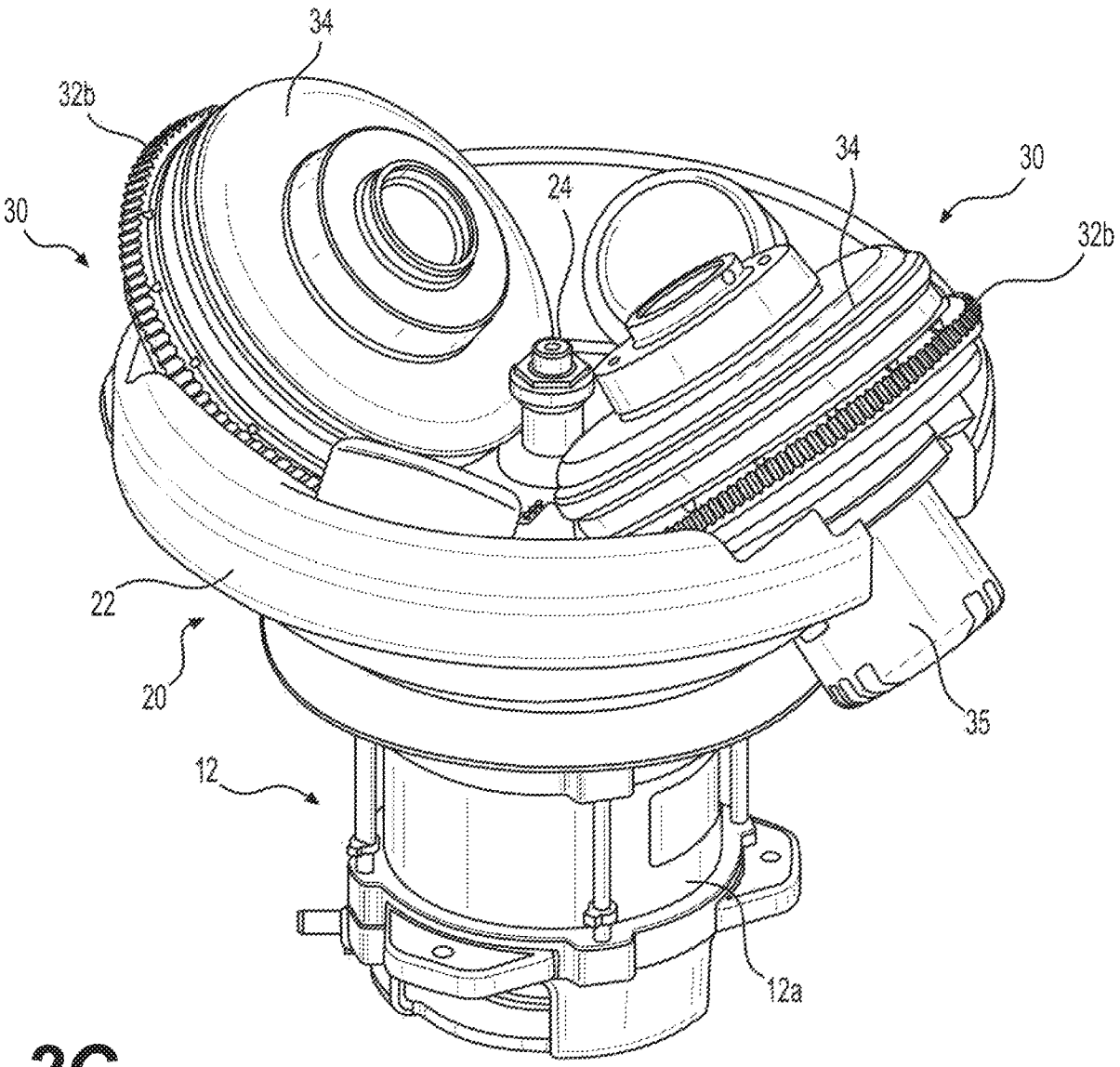
FIG. 2*c* is a perspective view of a DC rotor of the type illustrated in FIGS. 1, 2*a* and 2*b* mounted on a driveshaft.

For ease of reference, FIG. 2*c* is a perspective view of the DC rotor 20 mounted on the drive motor 12.

Figure 3A:
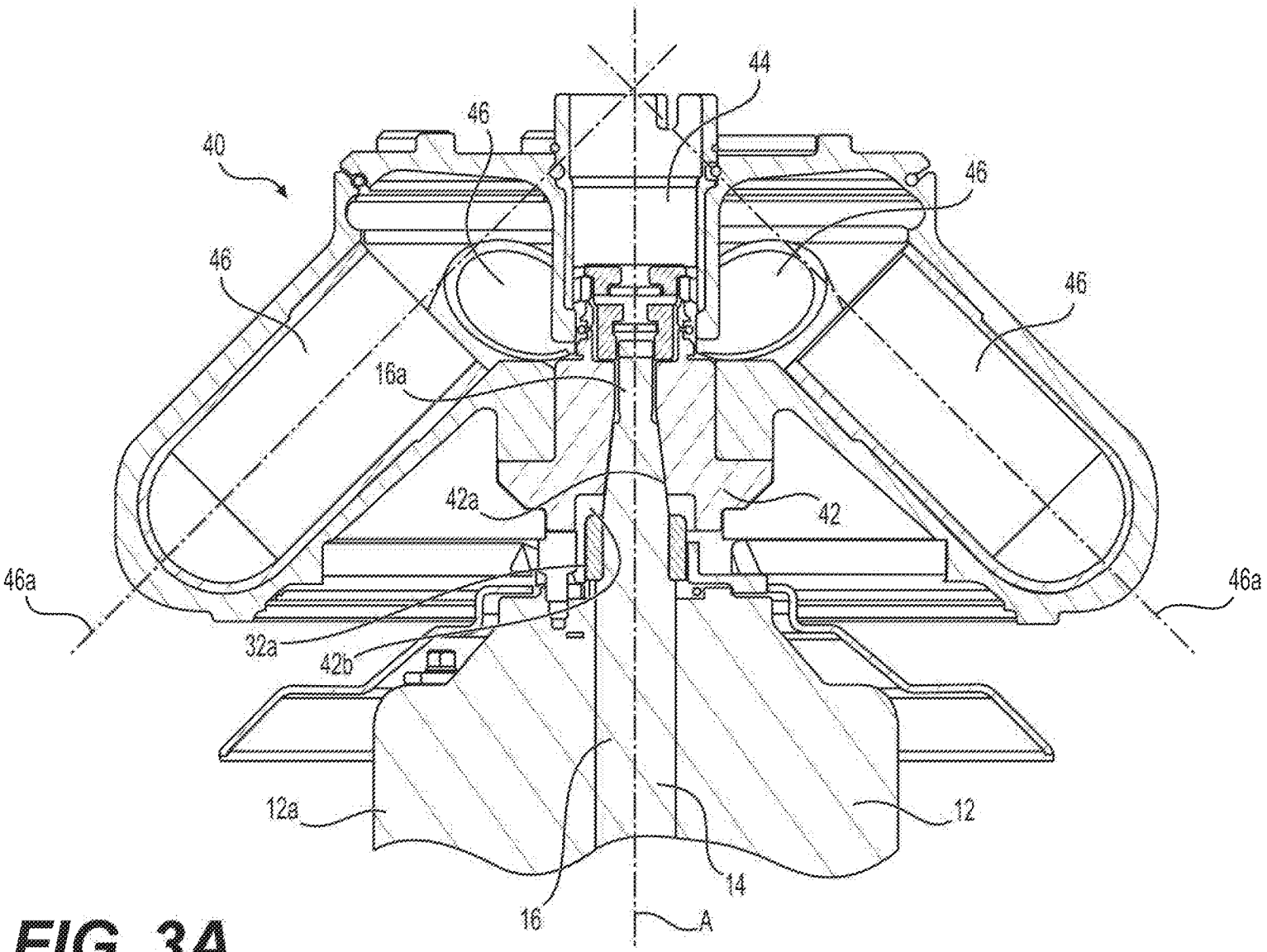
FIG. 3*a* is a lateral sectional view of an angle head rotor mounted on a driveshaft in the manner specified by the present invention and of the portion of the drive motor which is close to the rotor.

FIG. 3*a* is a lateral sectional view of an angle head rotor 40 according to the invention which is suitable for fitting on the drive motor 12, as well as of the portion of the drive motor 12 which is close to the rotor. This view shows the angle head rotor 40 after it has been taken off the drive motor 12.

The angle head rotor has a central rotor hub 42 and an opening 42*a* through which the driveshaft 16, in a mounted state thereof, engages the angle head rotor 40. As in the case of the previously illustrated DC rotor 20, on the side of the angle head rotor 40 facing away from the drive motor 12, a quick fastener 44 is centrally provided which is engaged by the end portion 16*a* of the driveshaft 16 when the angle head rotor 40 is placed on the drive motor 12 and is fixed by a push-down mechanism not shown in detail for reasons of clarity.

Along the periphery of the angle head rotor 40, receiving bores 46 are uniformly distributed for receiving sample containers (not shown) which bores 46 each have a longitudinal axis 46*a*. The receiving bores 46 are inclined relative to the rotor 40 in such a way that their longitudinal axes 46*a* will intersect at an acute angle on the drive axis A above the driveshaft 16. This lateral sectional view shows four receiving bores 46.

As already set out with reference to FIGS. 1 and 2*a*, a central gear 32*a* is disposed on the motor housing 12*a* as part of the additional drive mechanism 32 required for driving the rotational units 30 in such a way that it will be penetrated by the driveshaft 16. To be able to fit the angle head rotor 40 easily on the drive motor 12 despite the presence of the central gear 32*a* not required for its operation, a central circumferential recess 42*b* associated with the central gear 32*a* is provided in the rotor hub 42, which recess 42*b* is larger than the central gear 32*a* so that the central gear 32*a* will not contact the rotor hub 42 once the angle head rotor 40 has been mounted. Consequently, also an angle head rotor 40 can be mounted in the dual centrifuge 10 intended for use with DC rotors 20.

Figure 3B:
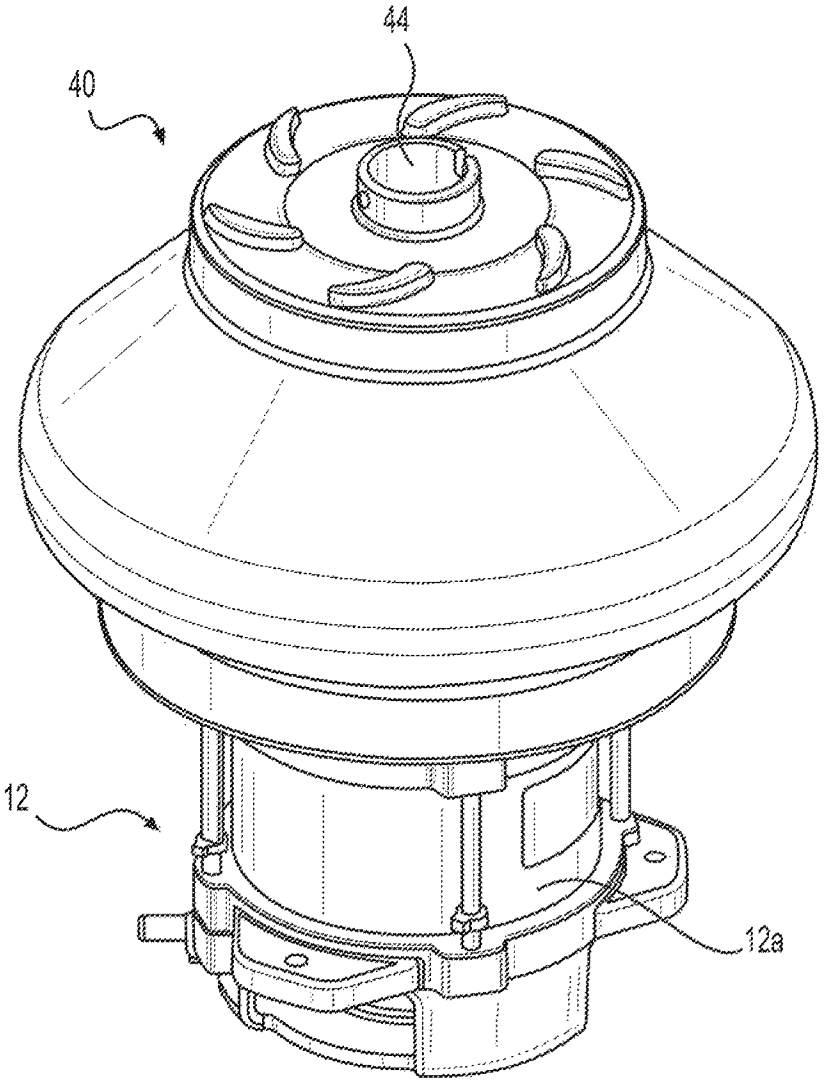
FIG. 3*b* is a perspective view of the angle head rotor illustrated in FIG. 3*a* mounted on a driveshaft and of the drive motor.

For ease of reference, the view of FIG. 3*b* shows the angle head rotor 40 mounted on the drive motor 12.

Figure 4A:
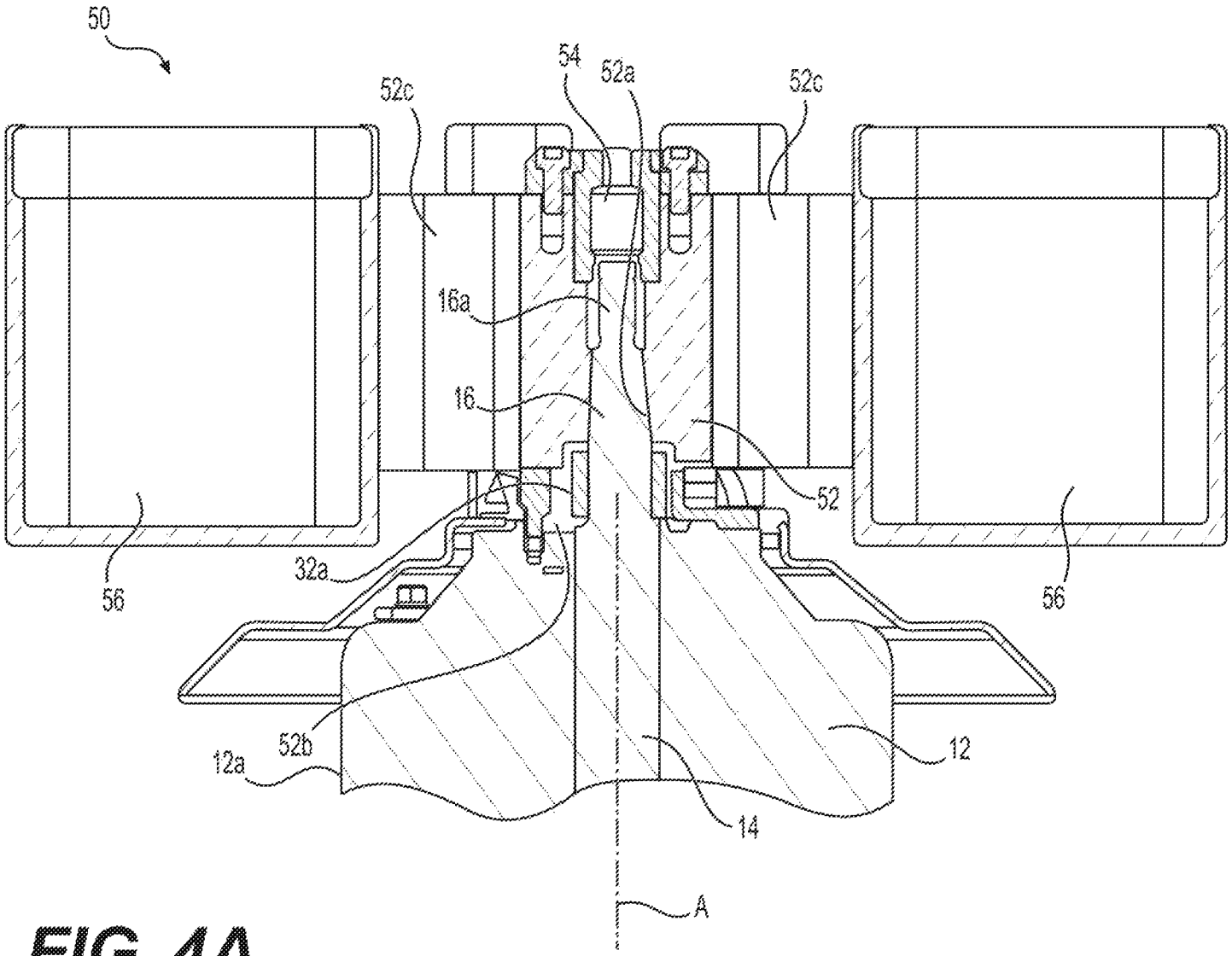
FIG. 4*a* is a lateral sectional view of a swing-out rotor mounted on a driveshaft in the manner specified by the present invention and of the portion of the drive motor which is close to the rotor.
Figure 4B:
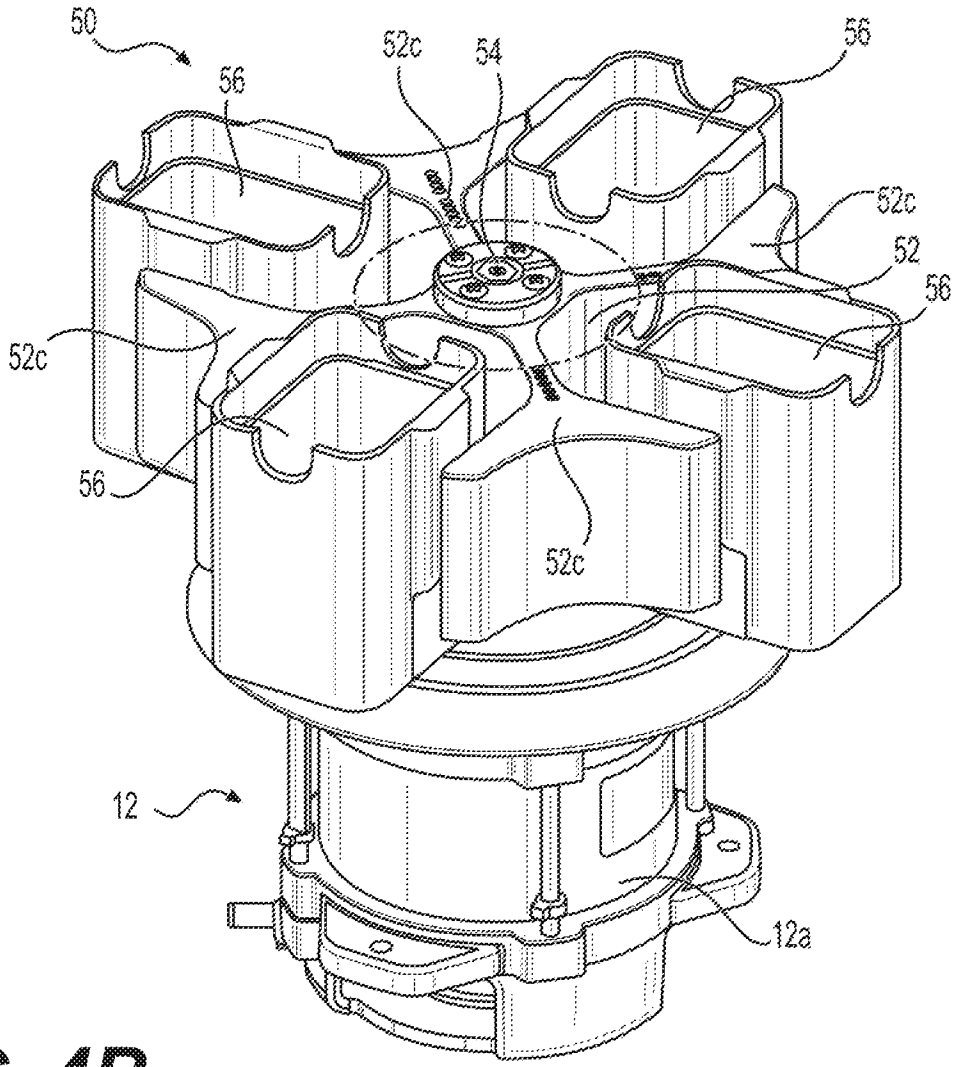
FIG. 4*b* is a perspective view of the swing-out rotor illustrated in FIG. 4*a* mounted on a driveshaft and of the drive motor.

FIG. 4*a* is a lateral sectional view of a swing-out rotor 50 mounted on the drive motor 12 as well as of the portion of the drive motor 12 which is close to the rotor. FIG. 4*b* is a perspective view of the swing-out rotor 50 and the drive motor 12.

Four Y-shaped support arms 52*c* are formed on a rotor hub 52, between which four swing-out buckets 56 are pivotally mounted for holding four sample container receptacles (not shown) for sample containers containing samples to be centrifuged. Similar to the angle head rotor 40, the swing-out rotor 50 has a central opening 52*a* which is engaged by the end portion 16*a* of the driveshaft 16. On the side of the swing-out rotor 50 which faces away from the drive motor 12 a quick fastener 54 is centrally disposed which is engaged by the end portion 16*a* of the driveshaft 16 when the swing-out rotor 50 is placed onto the drive motor 12 and which is fixed by a push-down mechanism not shown in detail for reasons of clarity.

As in the case of the angle head rotor 40 illustrated in FIG. 3*a*, a central circumferential recess 52*b* associated with the central gear 32*a* is provided in the rotor hub 52, which recess 52*b* is larger than the central gear 32*a* so as to prevent the central gear 32*a* from contacting the rotor hub 52 once the swing-out rotor 50 has been mounted. Consequently, a swing-out rotor 50 can also be mounted in the dual centrifuge 10 intended for use with DC rotors 20.

LIST OF REFERENCE SIGNS

10 dual centrifuge
11 centrifuge housing
11*a* underside
11*b* housing cover
12 drive motor
12*a* motor housing
14 motor shaft
16 driveshaft
16*a* end portion
20 DC rotor
22 rotor hub
22*a* opening
24 quick fastener
26 opening
30 rotational unit
32 additional drive mechanism
32*a* central gear
32*b* toothing
32*c* central gear
33 retaining pin
33*a* recess
34 rotational head
35 housing
36 pivot bearing
40 angle head rotor
42 rotor hub
42*a* opening
42*b* recess
44 quick fastener
46 receiving bore
46*a* longitudinal axis
50 swing-out rotor
52 rotor hub
52*a* opening
52*b* recess
52*c* support arms
54 quick fastener
56 swing-out bucket
60 safety vessel
60*a* sidewall
60*b* vessel bottom
60*c* opening
E removal direction
A drive axis
R rotational axis

The invention claimed is:

1. A dual centrifuge, comprising a) driveshaft, b) a first rotor designed as a dual centrifuge rotor which is mounted on the driveshaft and which dual centrifuge rotor can be removed from the driveshaft axially in a removal direction, and having one or plural rotational units, c) an opening in the first rotor which is at least engaged by an end portion of the driveshaft, d) an additional drive mechanism for the one or plural rotational units, and e) at least one second rotor of a type different from the first rotor, wherein only one of the first and second rotors is arranged on the driveshaft at a time, and wherein the second rotor is adapted to the additional drive mechanism for the one or plural rotational units, characterized in that the at least one second rotor is selected from one of an angle head rotor and a swing-out rotor, for which a bearing, the driveshaft and the selected second rotor are adapted to one another, with the selected second rotor having a geometry that is dimensioned such that, after the selected second rotor has been mounted on the driveshaft, the additional drive mechanism for the one or plural rotational units is configured so as not to contact the mounted selected second rotor.

2. A dual centrifuge according to claim 1 wherein at least each the first rotor, and the at least one second rotor has a quick fastener for mounting on and securing the respective first or second rotor to the driveshaft.

3. A dual centrifuge according to claim 2 characterized in that the driveshaft is directly connected to a drive motor, wherein the driveshaft and a motor shaft of the drive motor constitute an integrally formed structural unit of the same material.

4. A dual centrifuge according to claim 1 characterized in that a safety vessel is provided in which the first rotor or the selected second rotor is arranged and into which at least part of the driveshaft projects, wherein the largest diameter of the first rotor or the selected second rotor is 96%, at the most, of the diameter of the safety vessel.

5. A dual centrifuge according to claim 1 characterized in that the driveshaft is designed as a solid shaft.

6. A dual centrifuge according to claim 1 characterized in that the one or plurality of rotational units are each rotatably mounted within a pivot bearing and include a rotary head connected to the pivot bearing via a rotation axis, which rotary head is driven relative to the first rotor by the additional drive mechanism of the centrifuge.

7. A dual centrifuge according to claim 6 characterized in that the first rotor has different transmission ratios provided for the additional drive mechanism.

8. A dual centrifuge according to claim 6 characterized in that the first rotor includes a central gear centrically arranged to form a structural unit therewith, wherein the central gear is connected for co-rotation with a motor and is operatively connected to at least one of the one or plurality of rotational units such that rotation of the first rotor will cause a gear of the connected one of the rotational units to mesh with the central gear.

9. A dual centrifuge according to claim 1 characterized in that the additional drive mechanism includes a gear which is firmly connected to a motor housing and is penetrated by the driveshaft.

10. A dual centrifuge according to claim 9 characterized in that the first rotor includes a central gear centrically arranged to form a structural unit therewith, wherein the central gear is connected for co-rotation with a motor and is operatively connected to at least one of the one or plurality of rotational units such that rotation of the first rotor will cause a gear of the connected one of the rotational units to mesh with the central gear.

* * * * *